US012503210B2

(12) United States Patent
Chen

(10) Patent No.: US 12,503,210 B2
(45) Date of Patent: Dec. 23, 2025

(54) PADDLE WITH NONLINEAR SHAFT

(71) Applicant: Shane Chen, Camas, WA (US)

(72) Inventor: Shane Chen, Camas, WA (US)

( * ) Notice: Subject to any disclaimer, the term of this patent is extended or adjusted under 35 U.S.C. 154(b) by 417 days.

(21) Appl. No.: 18/213,796

(22) Filed: Jun. 23, 2023

(65) Prior Publication Data

US 2024/0002026 A1 Jan. 4, 2024

Related U.S. Application Data

(60) Provisional application No. 63/355,292, filed on Jun. 24, 2022, provisional application No. 63/355,067, filed on Jun. 23, 2022.

(51) Int. Cl.
*B63H 16/04* (2006.01)

(52) U.S. Cl.
CPC ..... *B63H 16/04* (2013.01)

(58) Field of Classification Search
CPC ..... B63H 16/04
See application file for complete search history.

(56) References Cited

U.S. PATENT DOCUMENTS 892,418 A * 7/1908 Hallman ..... B63H 16/12 440/25
3,297,283 A * 1/1967 Knaver ..... B63H 16/20 440/26
5,364,296 A * 11/1994 Cerny ..... B63H 16/04 416/74
8,419,487 B2 * 4/2013 Parker ..... B63H 16/00 440/13
2008/0242163 A1 * 10/2008 Bowen ..... B63H 16/04 440/101
2015/0291268 A1 * 10/2015 Shoemaker ..... B63H 16/04 440/101
2021/0107614 A1 * 4/2021 Czubin ..... B63B 34/26
2022/0396342 A1 * 12/2022 Wood ..... B63H 16/04

FOREIGN PATENT DOCUMENTS

CA 2982051 A1 * 4/2018 ..... B63B 34/20

* cited by examiner

*Primary Examiner* — S. Joseph Morano
*Assistant Examiner* — Jovon E Hayes

(57) ABSTRACT

A paddle for propelling a watercraft that has a nonlinear shaft which allows the paddle blade to be positioned underneath the watercraft and brought very close to, or directly under, the centerline of the craft. This has advantages in efficiency of propulsion and speed of forward travel by greatly reducing unwanted yaw and lateral travel.

11 Claims, 2 Drawing Sheets

PADDLE WITH NONLINEAR SHAFT

CROSS REFERENCE TO RELATED APPLICATIONS

This application claims the benefit of U.S. Provisional Application No. 63/355,067, filed Jun. 23, 2022, and U.S. Provisional Application No. 63/355,292, filed Jun. 24, 2022, both entitled Under Board Paddle and having the same inventor as above.

FIELD OF THE INVENTION

The present invention relates to paddles for human powered watercraft and, more specifically, to paddles for paddle boards and the like.

BACKGROUND OF THE INVENTION

Conventional paddles used for propelling watercraft including stand-up paddle (SUP) boards have a straight shaft connected to a blade. A user stands on the board and uses both hands to grip the shaft and apply force to the paddle. As is typically the case with paddle- or oar-propelled craft, the paddle blade contacts the water to the side of the craft throughout the paddle stroke. On watercraft where the user paddles on one side of the craft at a time, the placement of the paddle blade to the side of the board is a disadvantage because it results in a noticeable amount of yaw with each paddle stroke. When the user intends to travel linearly forward, this yaw is unproductive and inefficient.

Furthermore, on SUP craft the user must switch hand placement in order to switch from paddling on one side of the craft to the other side. SUP users therefore frequently paddle multiple consecutive strokes on one side before switching to do the same on the other side, which exacerbates unwanted yaw and lateral travel. Positioning the paddle blade as close as possible to the SUP board during a paddle stroke is not fully effective in preventing unwanted yaw because, when tried, a straight paddle shaft will often contact the board which impedes the paddling stroke and may damage the board, over time.

SUMMARY OF THE INVENTION

The present invention is a paddle with a nonlinear shaft that allows the paddle blade to be positioned underneath a watercraft during a paddle stroke. Since the nonlinear shaft is not obstructed by the sides of the craft, the blade can be positioned very near, or even directly under, the centerline of a watercraft, while the user's hands gripping the paddle shaft are also near the same centerline above the craft. This configuration has the effect of allowing the user to operate a virtual straight paddle which passes through the body of the watercraft, in order to paddle very near the centerline of the craft to minimize unwanted yaw.

Modern materials allow a paddle with a nonlinear shaft to be both stiff and light, and therefore effective enough and practical enough for use. The present invention can be used in paddles for stand-up paddle boards, kayaks, and other paddle- or oar-propelled watercraft, particularly those which are typically operated by paddling one side of the craft at a time.

These and related objects of the present invention are achieved by use of a paddle with nonlinear shaft as described herein.

The attainment of the foregoing and related advantages and features of the invention should be more readily apparent to those skilled in the art, after review of the following more detailed description of the invention taken together with the drawings.

DETAILED DESCRIPTION

Figure 1:
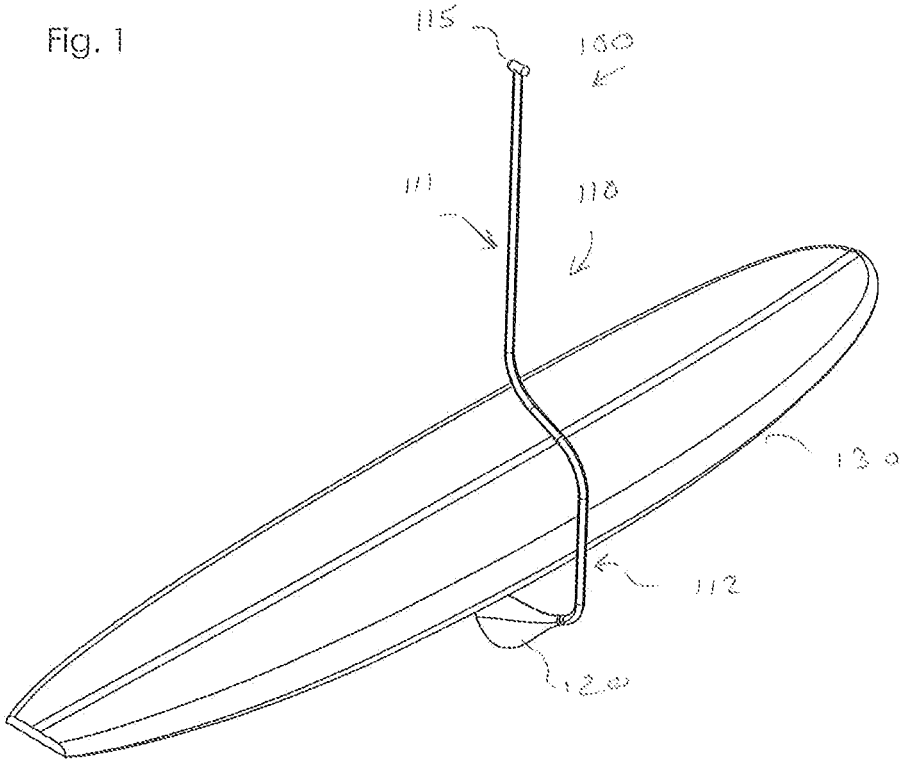
FIGS. 1 and 2 are a perspective view and a rear elevation view, respectively, of one embodiment of a paddle in accordance with the present invention.
Figure 2:
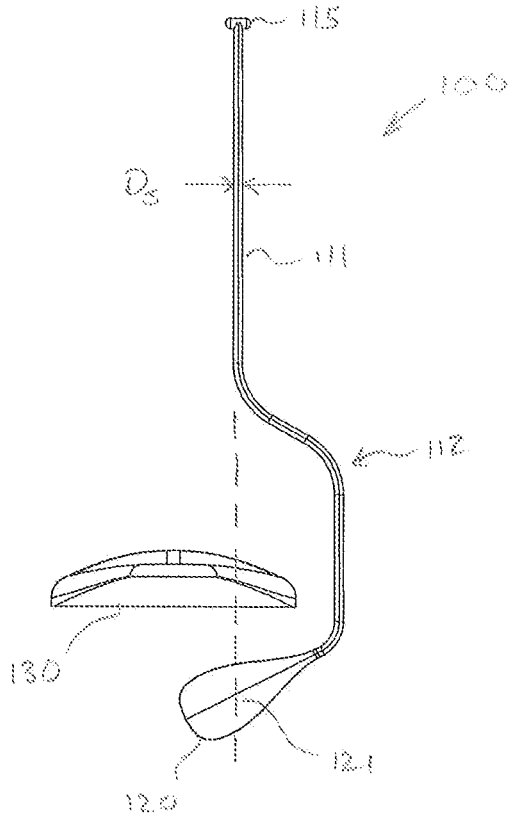

Referring to FIGS. 1 and 2, an embodiment of a paddle 100 in accordance with the present invention is shown. This embodiment is designed for use with a stand-up paddle (SUP) board 130. Paddle 100 comprises a shaft 110 and a blade 120. In this embodiment, shaft 110 has a substantially linear straight section 111 and a curved section 112. Blade 120 is coupled to the end of curved section 112, and the curvature of curved section 112 may be substantially coplanar with a best fit plane of blade 120.

A handle, grip, surface or other configuration 115 that extends laterally from the shaft is preferably provided at or near the top of the straight section or lower down to allow a user to deftly orient the blade relative to the water. This handle or grip structure 115 preferably extends perpendicular to a straight-forward line of direction through the paddle (when paddling straight-forward), and may vary+/−10, 15, 20 or even 25 degrees or more from perpendicular without departing from the present invention. This is a variation in yaw angle, when the paddle axis is vertical. The grip structure 115 may be configured in various arrangements including surface shaping along the shaft that identifies a given orientation of the blade when held by a user (i.e., an alignment between the fashioned surface and the blade).

When using paddle 100 to propel a board 130 upon which a user is standing, sitting, kneeling or otherwise supported, the user grips straight section 111 with both hands and applies paddling force through shaft 110. During a typical paddle stroke, blade 120 is inserted into the water to the side of board 130 and anterior to the user's position, and then drawn backwards relative to board 130 to propel the board forward. At the end of the stroke, blade 120 is removed from the water and moved forward above the water surface to begin the next stroke. During a stroke, straight section 111 is above board 130, curved section 112 curves around board 130, and blade 120 is underneath board 130 (this can be seen in FIG. 2). This has the effect of allowing the user to operate a virtual straight paddle which passes through the board during a paddle stroke and enables blade 120 to be brought very close to, or directly under, the centerline of the board, thereby greatly reducing unwanted yaw.

In one embodiment, the center of area 121 of blade 120 may be intersected by a virtual line or "paddle axis" passing through straight section 111, or through the hands of a user grasping the section 111 and executing a paddle stroke. Blade 120 may have a water contacting surface or "face" configured for (near) maximum resistance against movement through water to thus propel the watercraft forward. This face may be provided on both sides of blade 120 to afford left and right side use.

While the orientation of the face and underlying blade may be vertical when the paddle axis is vertical, it can vary+/−10, 15, 20, 25 or more degrees in pitch angle from vertical without departing from the present invention. Similarly, while the face (and/or blade) may be oriented perpendicular to a straight-forward line of travel, the face/blade may also vary up to +/−10, 15, 20, or more degrees in yaw angle (similar to gripping structure 115).

As seen in FIG. 2, the blade may extend laterally on both sides of the paddle axis and it may extend in a direction perpendicular to the lateral extension. The first shaft section 111 may have a diameter or other horizontal cross-sectional dimension (if not round), DS, that is thin relative to the blade. For example, the blade may extend in a direction perpendicular to the lateral extension that measures multiple times DS, e.g., 2, 3, 4, 5, or 6-10 or more times DS.

The shape of curved section 112 in this embodiment is selected to fit around an average SUP board. Paddles specially intended for boards of wider or narrower widths will ideally have shaft shapes which suit the style of board for which they are intended. In FIGS. 1-2, shaft 110 has a straight section 111 and a curved section 112 to achieve the result of allowing the user's hands and blade 120 to be positioned near the centerline of board 130 during a paddle stroke, though other embodiments may have different shapes without departing from the present invention. For instance, curved section 112 may be replaced by two or more short straight sections coupled at angles to each other, or straight section 111 may be replaced with one or more non-straight shaft sections for ergonomic or ornamental purposes.

The curved or displaced section 112 may have a best-fit plane that transects it. The blade may similarly have such a plane. In one embodiment, the best fit planes may be parallel or even coplanar. Yet, in other embodiments, their arrangement may vary in pitch and yaw (when the paddle axis is vertical) relative to one another. This variation may be +/−10, 15, 20, 25 degrees or more (in pitch or yaw angle) without departing from the present invention.

Shaft 110 is made of a stiff material not subject to substantial warping during a paddle stroke. Carbon fiber is an example of a suitable material which is also very light. The rigidity of the material allows a paddling force applied to straight section 111 to be efficiently transferred through curved section 112 to blade 120.

The present embodiment shows the invention being used to propel a SUP board, but the paddle of the present invention can also be used with other paddle- or oar-propelled watercraft.

Figure 3:
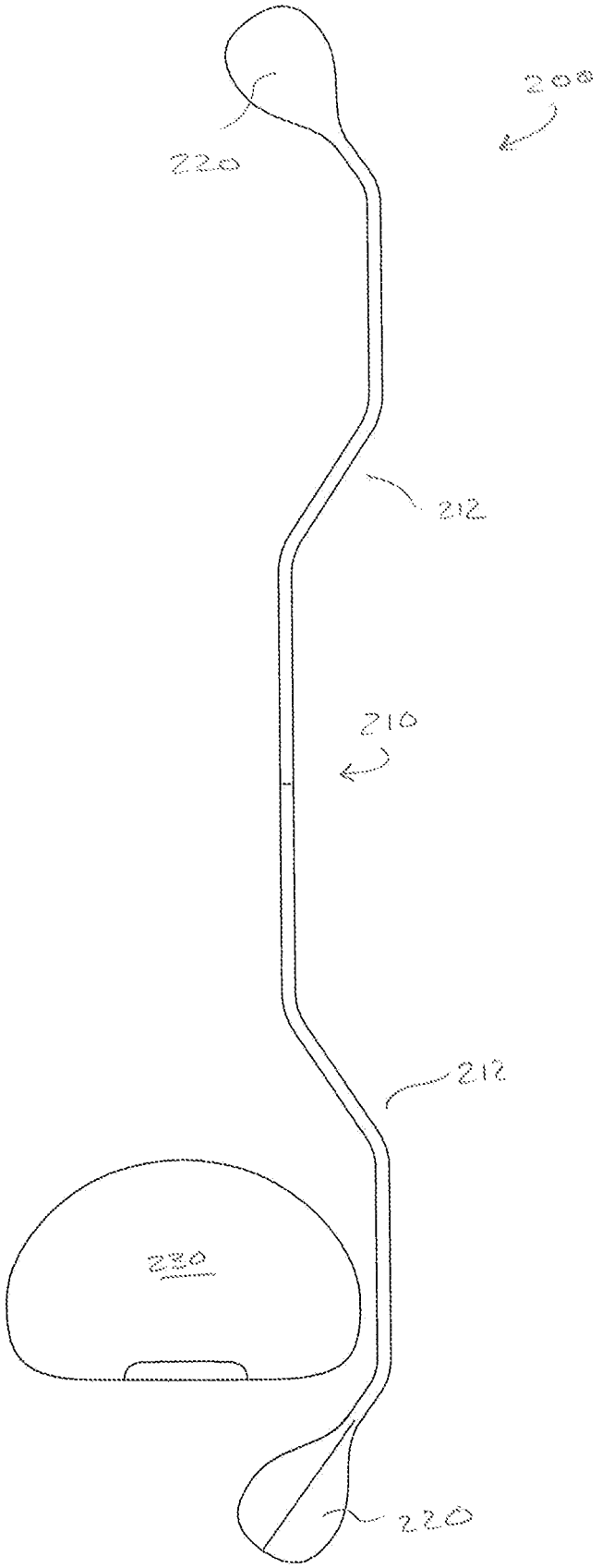
FIG. 3 is a rear elevation view of another embodiment of a paddle in accordance with the present invention.

FIG. 3 shows another embodiment of a paddle 200 in accordance with the present invention. This embodiment is designed for use with a kayak 230. Paddle 200 comprises a shaft 210 and two blades 220. Shaft 210 has a substantially linear straight section 211 and two curved sections 212 coupled to opposite ends of straight section 211. Blades 220 are coupled to curved sections 212. The user grips straight section 211 and alternates paddling once on each side of kayak 230. During a paddle stroke the curved section 212 currently contacting the water fits around the cross section of kayak 230, enabling blade 220 to be positioned underneath kayak 230 in the same manner as the SUP paddle in the embodiment in FIGS. 1-2.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A paddle for propelling a watercraft, comprising:

a shaft having a force application section, including at least two force application points for execution of a paddle stroke, and a displaced section, the force application section defining a paddle axis passing through the at least two force application points, and the displaced section extending laterally away from the paddle axis, viewed from a rear elevation cross-section with the paddle axis oriented vertically and in a straightforward paddle stroke; and a blade coupled to a distal end of the displaced section shaft, extending laterally from both sides of the paddle axis and also extending in a direction perpendicular to the lateral extension when viewed from a rear elevation cross-section with the paddle axis oriented vertically and in a straightforward paddle stroke.

2. The paddle of claim 1, wherein a best-fit plane of the blade has a pitch angle that is less than +/−25 degrees from vertical when the paddle axis is vertical.

3. The paddle of claim 1, wherein the displaced section extends laterally back towards the paddle axis, vertically below the portion where the displaced section extends from the paddle axis.

4. A paddle device for human propulsion of a watercraft, comprising:

a first shaft section that can be gripped by a user at at least two grip points and that defines a paddle axis passing through the at least two grip points of the first shaft section and is configured to be oriented by a user, when grasped, for execution of a paddle stroke;

a second shaft section coupled to the first shaft section that extends away from the paddle axis and is configured to fit around a watercraft during a forward stroke by a user thereon; and a blade coupled to an end of the second shaft section; and wherein, when the paddle axis is vertical and the paddle is viewed from a rear elevation cross-section in a straight-forward paddle stroke, the paddle axis intersects the blade.

5. The device of claim 4, wherein the first shaft section has a fashioned surface that is positioned within the first shaft section to indicate by feel an orientation of the paddle when grasped by a user, and wherein the first shaft section has a fixed alignment with the blade such that the positioning of the fashioned surface in a given orientation achieves a similar orientation positioning of the blade.

6. The paddle of claim 1, wherein the force application section includes a first force application structure configured to orient the shaft in a given position.

7. The paddle of claim 6, wherein the force application section has a front aspect facing front and a rear aspect facing rear, when the paddle axis is substantially vertical and the paddle is positioned for a straight forward paddle stroke on a given watercraft, the first force application structure has a fashioned surface that extends laterally from the paddle axis between the front and rear aspects and has a fixed alignment with the blade.

8. The paddle of claim 1, wherein a best-fit plane of the blade has a yaw angle that is less than +/−25 degrees from vertical when the paddle axis is vertical.

9. The paddle of claim 4, wherein a best-fit plane of the blade has a pitch angle that is less than +/−25 degrees from vertical when the paddle axis is vertical.

10. The paddle of claim 4, wherein a best-fit plane of the blade has a yaw angle that is less than +/−25 degrees from vertical when the paddle axis is vertical.

11. The device of claim 5, wherein the first shaft section has a front aspect facing front and a rear aspect facing rear, when the paddle axis is substantially vertical and the paddle is positioned for a straight forward paddle stroke on a given watercraft, and wherein the fashioned surface extends laterally from the paddle axis, between the front and rear aspects, and has a fixed alignment with the blade.

* * * * *